US008651434B2

(12) United States Patent
Daum et al.

(10) Patent No.: US 8,651,434 B2
(45) Date of Patent: Feb. 18, 2014

(54) METHODS AND SYSTEMS FOR RAIL COMMUNICATION

(75) Inventors: Wolfgang Daum, Erie, PA (US); Jared Klineman Cooper, Palm Bay, FL (US)

(73) Assignee: General Electric Company, Schenectady, NY (US)

( * ) Notice: Subject to any disclaimer, the term of this patent is extended or adjusted under 35 U.S.C. 154(b) by 299 days.

(21) Appl. No.: 12/911,816

(22) Filed: Oct. 26, 2010

(65) Prior Publication Data

US 2012/0097803 A1 Apr. 26, 2012

(51) Int. Cl.
*B61L 3/00* (2006.01)

(52) U.S. Cl.
USPC ..... 246/178

(58) Field of Classification Search
USPC ..... 246/20, 27, 28 R, 33, 34 R, 167 R, 177, 246/178, 182 R
See application file for complete search history.

(56) References Cited

U.S. PATENT DOCUMENTS

| | | | | |
|---|---|---|---|---|
| 1,517,549 | A | | 12/1924 | Espenschied |
| 3,694,751 | A | | 9/1972 | Takahashi et al. |
| 3,714,419 | A | | 1/1973 | Fosse et al. |
| 3,715,669 | A | | 2/1973 | LaForest |
| 3,750,020 | A | | 7/1973 | Baba |
| 3,949,959 | A | | 4/1976 | Rhoton |
| 4,074,879 | A | | 2/1978 | Clark |
| 4,207,569 | A | | 6/1980 | Meyer |
| 4,369,942 | A | | 1/1983 | Wilson |
| 4,420,133 | A | * | 12/1983 | Dietrich ..... 246/167 R |
| 4,442,988 | A | * | 4/1984 | Laurent et al. ..... 246/34 CT |
| 4,491,967 | A | | 1/1985 | Kobayashi |
| 4,498,650 | A | | 2/1985 | Smith |
| 4,645,148 | A | | 2/1987 | Kolkman |
| 4,655,421 | A | | 4/1987 | Jaeger |
| 4,910,793 | A | | 3/1990 | Mainardi |
| 5,019,815 | A | | 5/1991 | Lemelson |
| 5,330,134 | A | * | 7/1994 | Ehrlich ..... 246/34 R |
| 5,507,456 | A | * | 4/1996 | Brown et al. ..... 246/167 R |
| 5,548,815 | A | | 8/1996 | Takayama |
| 5,749,547 | A | | 5/1998 | Young |
| 5,867,404 | A | | 2/1999 | Bryan |
| 6,102,340 | A | | 8/2000 | Peek |
| 6,216,985 | B1 | | 4/2001 | Stephens |
| 6,830,224 | B2 | * | 12/2004 | Lewin et al. ..... 246/167 R |

* cited by examiner

*Primary Examiner* — R. J. McCarry, Jr.
(74) *Attorney, Agent, or Firm* — GE Global Patent Operation; John A. Kramer

(57) ABSTRACT

Systems and methods for communicating through a rail are provided. In one embodiment, a method for communicating through a rail is provided. The method includes sending an acoustic signal through the rail of a designated section of track. The acoustic signal includes control commands to remotely control operation of a rail vehicle on the designated section of track.

14 Claims, 4 Drawing Sheets

METHODS AND SYSTEMS FOR RAIL COMMUNICATION

FIELD

The present disclosure is related to methods and systems for communicating data over a rail.

BACKGROUND

Data communication is conducted between different devices in a variety of ways to distribute information. For example, in a multiple-unit rail vehicle, such as a train, electronically controlled pneumatic (ECP) braking system data is passed to each car of the train through a wire that runs the length of the train connecting each car. However, wired communication through the ECP line has some issues. For example, installation of the ECP wire into different train configurations is time consuming. As another example, if a break occurs in the ECP line, operation of the ECP braking system degrades.

As another example, in a rail yard, wireless communication is conducted between two devices, such as rail vehicle data radios, through a dedicated, narrow-band radio link. However, wireless communication in the rail yard has some issues. For example, due to the density of rail vehicles and associated wireless communication devices in the rail yard, available frequency bandwidth for wireless communication is scarce. Moreover, due to the density of rail vehicles and associated wireless communication devices in the rail yard, wireless data communication interference is prevalent in the rail yard.

BRIEF DESCRIPTION

Accordingly, to address the above issues, various embodiments of systems and methods for controlling rail vehicle data communications are described herein. For example, in one embodiment, a method for communicating through a rail is provided. The method includes sending an acoustic signal through the rail of a designated section of track. The acoustic signal includes control commands to remotely control operation of a rail vehicle on the designated section of track.

By sending acoustic signals through a rail to a rail vehicle, the rail vehicle can be wirelessly remote controlled without taking up bandwidth over the airwaves. Such a communication system can be advantageously implemented in a rail yard setting where the acoustic signals are confined to a designated section of track due to physical gaps in the rails created by switches, for example. Accordingly, acoustic signal interference along a rail is reduced since acoustic signal are physically limited to a particular section of track.

This brief description is provided to introduce a selection of concepts in a simplified form that are further described below in the detailed description. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
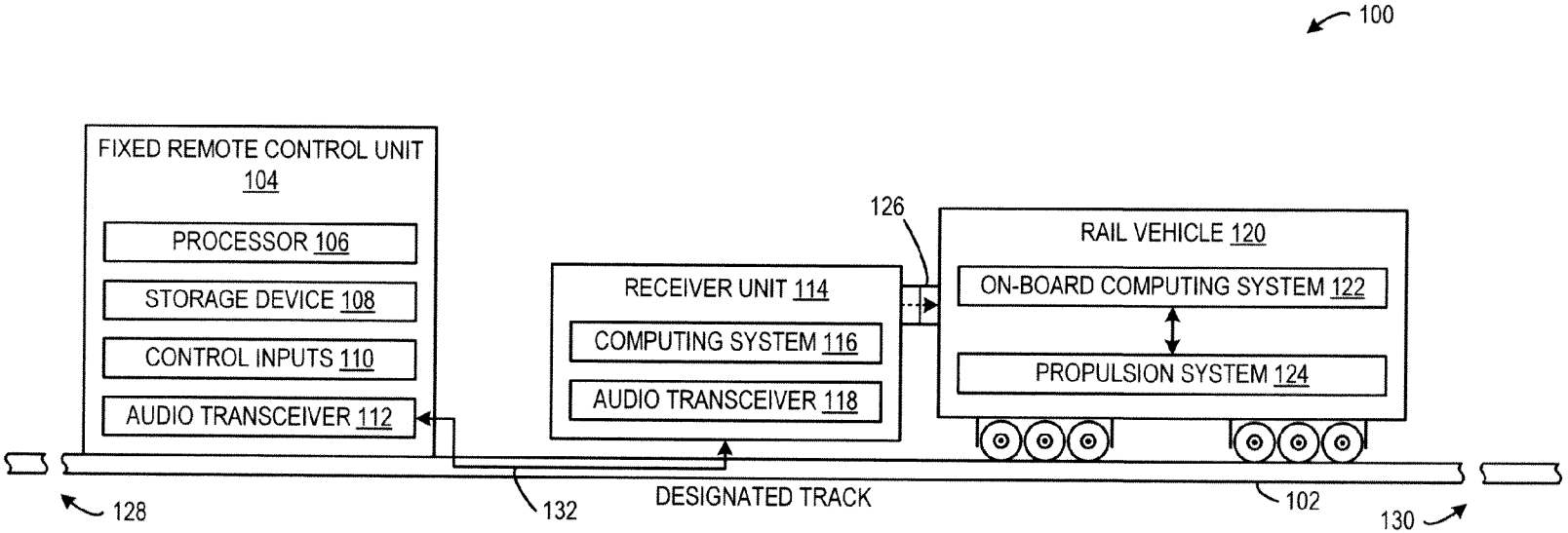
FIG. 1 is a schematic diagram of an example embodiment of a communication system of the present disclosure.

The present disclosure is directed to methods and systems for communicating data through a rail, such as a rail of a rail road track. More particularly, the present disclosure is directed to methods and systems for sending and receiving acoustic signals through a rail of a track to control operation of a rail vehicle traveling on the track. For example, as depicted in FIG. 1, a remote control unit generates acoustic signals based on user input. The remote control unit sends the acoustic signals through a rail to a receiver unit that is coupled to a rail vehicle traveling on the rail. The receiver unit generates control commands based on the received acoustic signals and sends the control commands, through an interface, to the rail vehicle to control operation of the rail vehicle. In other words, rail vehicle operation is adjusted in response to receiving the acoustic signals including control commands from the remote control unit. For example, rail vehicle speed or braking is adjusted in response to receiving the acoustic signals.

In one example, controlling operation of a rail vehicle by sending acoustic signals through a rail is advantageously implemented in a rail yard. In particular, since a rail yard has a high density of rail vehicles, communication over the airwaves, such as by using data radios, can be challenging due to the scarcity of available frequency bandwidth for wireless communication and associated interference created by the density of communications over the airwaves. By sending acoustic signals through the rail, rail vehicles can be controlled without taking up frequency bandwidth over the airwaves while avoiding communication interference over the airwaves.

Furthermore, acoustic signal communication is particularly beneficial in rail yard applications, because tracks in the rail yard are separated by switches that create physical gaps in the rails. These gaps cordon-off the track into separate sections and enable acoustic signal transmissions to be limited to a particular section by the gaps that define the section. Since the acoustic signal transmissions are limited to a particular section, the likelihood of interference from acoustic signals from other sections of track is reduced.

In one example, to further reduce the likelihood of acoustic signal interference in the rail, each section of track is assigned a different acoustic signal transmission frequency (or another signal identifier), or frequency bandwidth. Thus, for example, if an acoustic signal having a different frequency (or identifier) is received, or a frequency outside a selected frequency range, the signal can be ignored. As another example, if an acoustic signal having a different frequency (or identifier) is received, it provides an indication that two adjacent sections of track have been acoustically linked, such as by a rail vehicle traversing the sections. In response to receiving such an indication, rail vehicle operation on the section of track can be adjusted to accommodate a possible entrance/exit of a rail vehicle to the section, such as by adjusting speed or braking operation to stop of the rail vehicle to avoid collision.

FIG. 1 is a schematic diagram of an example embodiment of a communication system 100 of the present disclosure. The communication system 100 enables communication between remote communication devices through a rail 102 (or both rails of a track). The communication system 100 includes a remote control unit 104 to communicate with a portable receiver unit 114, which is coupled to a rail vehicle 120, by sending acoustic signals 132 through the rail 102. The acoustic signals may include the structure-borne transmission of sound waves through the rail. The remote control unit 104 generates the acoustic signals 132 based on user input to the remote control unit 104. The receiver unit 114 provides control commands based on the acoustic signals 132 to the rail vehicle 120 through an interface 126 to control operation of the rail vehicle 120.

In one example, the remote control unit 104 is positionally fixed and permanently coupled to a designated section of track that is defined by physical gaps in the rail 102. For example, a first gap 128 and a second gap 130 define the section of track designated for the remote control unit 104 to control rail vehicle operation. The first gap 128 and the second gap 130 limit acoustic signals sent through the rail 102 to the designated section of track.

In one example, the positionally fixed remote control unit 104 acts as a command center for an operator to remotely control operation of one or more rail vehicles on one or more sections of track from a single location. The remote control unit 104 controls operation of a rail vehicle that travels in the designated section of track, such as the rail vehicle 120. Alternatively, the remote control unit 104 may be portable and not positionally fixed.

In one example, the receiver unit 114 is portable and is configured to be temporarily coupled to the rail vehicle 120 through the interface 126 to send control commands to the rail vehicle 120 to adjust operation. For example, an operator plugs the portable receiver unit 114 into the rail vehicle 120 through the interface 126 to control operation of the rail vehicle 120 while the rail vehicle 120 is in the designated section of track. In such a configuration, the interface 126 is configured to temporarily couple the portable receiver unit 114 to the rail vehicle 120, and the interface 126 is compatible for temporary coupling to a plurality of different rail vehicles. Accordingly, the remote control unit 104 is able to remotely control operation of different rail vehicles (e.g., one at a time) as they travel through the designated section of track by interfacing each of the rail vehicles with the portable receiver unit 114. Such a configuration enables an operator to remotely control different rail vehicles from a single positionally fixed location on a designated section of track without employing complex acoustic signaling protocols.

The above described configuration is particularly beneficial to rail yard applications where the track is cordoned-off into sections by physical gaps in the rail of the track to accommodate switches and other devices. In particular, since the acoustic signals are confined to a section of a rail between the gaps, a remote control unit is coupled to a particular section to provide communication capability through the rail for that section of the track.

It will be appreciated that this is one example configuration, and other configurations may be implemented. For example, instead of having a portable receiving unit that interfaces with different rail vehicles, each rail vehicle includes a receiving unit. As another example, the remote control unit 104 may be portable and may temporarily couple to different sections of a track to control a rail vehicle. However, such configurations would add complexity to acoustic signaling protocols. Furthermore, in some embodiments, the remote control unit 104 is configured to send and/or receive signals through a third rail, a catenary line, or other physical (non-wireless) medium.

Continuing with FIG. 1, the remote control unit 104 includes a processor 106, a non-transitive storage device 108 that holds instructions that when executed by the processor 106 perform operations to control the remote control unit 104, control inputs 110, and an audio transceiver 112. The remote control unit 104 is configured to provide acoustic signals 132 to the rail 102 based on user input to the control inputs 110.

The control inputs 110 enable an operator to provide control commands to control operation of the rail vehicle 120. In one example, the control inputs 110 include buttons, switches, and the like that are physically actuated to provide input. In one example, the control inputs 110 include a touch sensitive display that senses touch input by the operator. In one example, the control inputs 110 include a speed control that includes a throttle input, a brake input, and a reverse input. In one example, where the rail vehicle is a loading rail vehicle, the control inputs 110 include lifting controls, such as to control a fork lift, a crane, a bucket loader, etc.

The audio transceiver 112 is coupled (or positioned proximate) to the rail 102 to transmit and receive acoustic signals through the rail 102. The audio transceiver 112 generates acoustic signals at different frequency bandwidths. In one example, the acoustic signals are produced at a frequency that is outside of a frequency bandwidth of an acoustic signature of wheels of the rail vehicle as well as other identifiable acoustic signatures produced by the rail vehicle. In one example, the audio transceiver 112 is tuned to produce an acoustic signal at a designated frequency that is assigned to a specific section of track. Correspondingly, different acoustic signal frequencies are designated for different sections of track so that designated acoustic signals can be easily identified. Moreover, acoustic signals that are received by the audio transceiver 112 that are not at the designated frequency can provide additional information. For example, the acoustic signal that is not at the designated frequency can indicate that another rail vehicle is entering the designated section of track. As another example, the acoustic signal can indicate that the rail vehicle under control is exiting the designated section of track. Such indications can be used to adjust operation of the rail vehicle under control to avoid a collision, losing control, or another unintended situation.

The audio transceiver 112 includes a suitable technology to produce acoustic signals through the rail 102. In one example, the audio transceiver 112 includes an acoustic coupler to generate the acoustic signals. In one example, the audio transceiver 112 includes sound transducers to generate the acoustic signals. In one example, the remote control unit 104 includes a source to produce laser-induced acoustic signals sent through the rail 102 to the portable receiver unit 114 to communicate through laser pinging.

The receiver unit 114 is configured to receive acoustic signals sent through the rail 102 and generate control commands based on the received acoustic signals to control operation of the rail vehicle 120. The receiver unit 114 includes a computing system or other control system 116 and a transceiver 118 (e.g., audio transceiver); the control system 116 is operably coupled to the transceiver 118. The audio transceiver 118 is positioned proximate (or coupled) to the rail 102 to detect acoustic signal sent through the rail 102. The audio transceiver 118 includes suitable technology to detect acoustic signals sent through the rail 102. For example, the audio transceiver 118 includes a microphone and/or a pickup. The computing system 116 is configured to generate control commands based on acoustic signals received by the audio transceiver 118. As discussed above, in one example the control commands include speed controls such as a throttle control, a brake control, and a reverse control to control the speed of the rail vehicle 120. In one example, the computing system 116 includes a storage device (e.g., read-only memory) that includes a look-up table including predefined control commands that are mapped to different acoustic signals. The computing system 116 provides the control commands from the look-up table that match the received acoustic signals to control operation of the rail vehicle 120.

The receiver unit 114 may receive the acoustic signals in various alternative ways. For example, the reception of the acoustical signal can occur through an optical device that may use reflective coherent light such as a laser. This detection occurs directly from the rail surface. Correction for inherent movement associated with a train in motion can be achieved by the use of a sensitive, phase coupled motion detecting device, fitted with an optically transparent loop, placed directly into the path of the transmitted control laser beam. As noted above, information from the phase coupled motion detecting device, may be used along with information from the reflected laser beam coming from the track, which is then used to provide corrective information used to compensate for the spurious movement and/or vibration associated with the moving rail vehicle and source laser. As noted above, the information received through such laser sensing of acoustic signals may be used to generate control commands for the rail vehicle.

Furthermore, the receiver unit 114 is configured to send feedback (e.g., via a feedback acoustic signal) to the remote control unit 104 indicating that the receiver unit 114 has received acoustic signals from the remote control unit 104. The audio transceiver 118 is configured to send acoustic signals generated based on commands from the computing system 116 through the rail 102 to the remote control unit 104. Correspondingly, the remote control unit 104 provides an indication to the operator confirming the feedback. For example, the remote control unit 104 provides visual feedback to the user, such as a blinking light that indicates the feedback is received.

In some embodiments, the remote control unit 104 provides open-loop control of the rail vehicle 120. The open-loop control includes one-way communication in which the remote control unit 104 does not receive feedback from the receiver unit 114. In such embodiments, the remote control unit 104 includes an audio transmitter that transmits acoustic signals and does not receive acoustic signals, instead of (or in addition to) an audio transceiver. Correspondingly, the receiver unit 114 includes an audio receiver that receives acoustic signals and does not send acoustic signals.

The receiver unit 114 couples to the rail vehicle 120 through interface 126. In some embodiments, the interface 126 provides a temporary coupling that facilitates disconnection from one rail vehicle and reconnection with another rail vehicle. In some embodiments, the interface 126 provides more permanent coupling. For example, the receiver unit 114 can be integrated into the rail vehicle 120. The interface 126 includes a suitable communicative coupling technology. In one example, the interface 126 includes a wired link with corresponding male and female connectors. In one example, the interface 126 includes a short distance radio frequency (RF) link. In one example, the interface 126 includes an infrared link between infrared ports of the receiver unit 114 and the rail vehicle 120.

The rail vehicle 120 is configured to travel on the rail 102. In one example, the rail vehicle 120 is a locomotive. In one example, the rail vehicle is a loader to load/unload cargo from rolling stock in a rail yard. The rail vehicle 120 includes an on-board computing system 122 and a propulsion system 124.

The on-board computing system 122 is configured to control operation of the propulsion system 124. In particular, the on-board computing system 122 controls operation of the propulsion system 124 based on operator input to the on-board computing system 122 or based on control commands received from the receiver unit 114. For example, the rail vehicle 120 operates in a first mode where control is provided by an operator through the on-board computing system. Further, when a the receiver unit 114 is interfaced with the rail vehicle 120, the rail vehicle 120 operates in a second operating mode where the rail vehicle is controlled by control commands based operator input to the remote control unit 104. The on-board computing system 122 controls operation of the propulsion system 124.

The propulsion system 124 includes actuators, the state of which is varied based on signals received from the on-board computing system 122 to adjust operation of the propulsion system 124. In one example, the propulsion system 124 includes an engine, such as diesel engine that combusts air and diesel fuel through compression ignition. In this example, actuators that are adjusted to control engine operation include cylinder valves, fuel injectors, throttle, etc. In one example, the propulsion system 124 includes fraction motors that are powered electrically and the actuators adjust electrical components. In this example, actuators that are adjusted to control electrical components include the alternator, traction motors, etc. Moreover, the propulsion system 124 includes brakes (not shown), such as air brakes or friction brakes that are operable to slow the rail vehicle 120. It will be appreciated that the actuators include a suitable component for adjusting operation of the rail vehicle 120.

Figure 2:
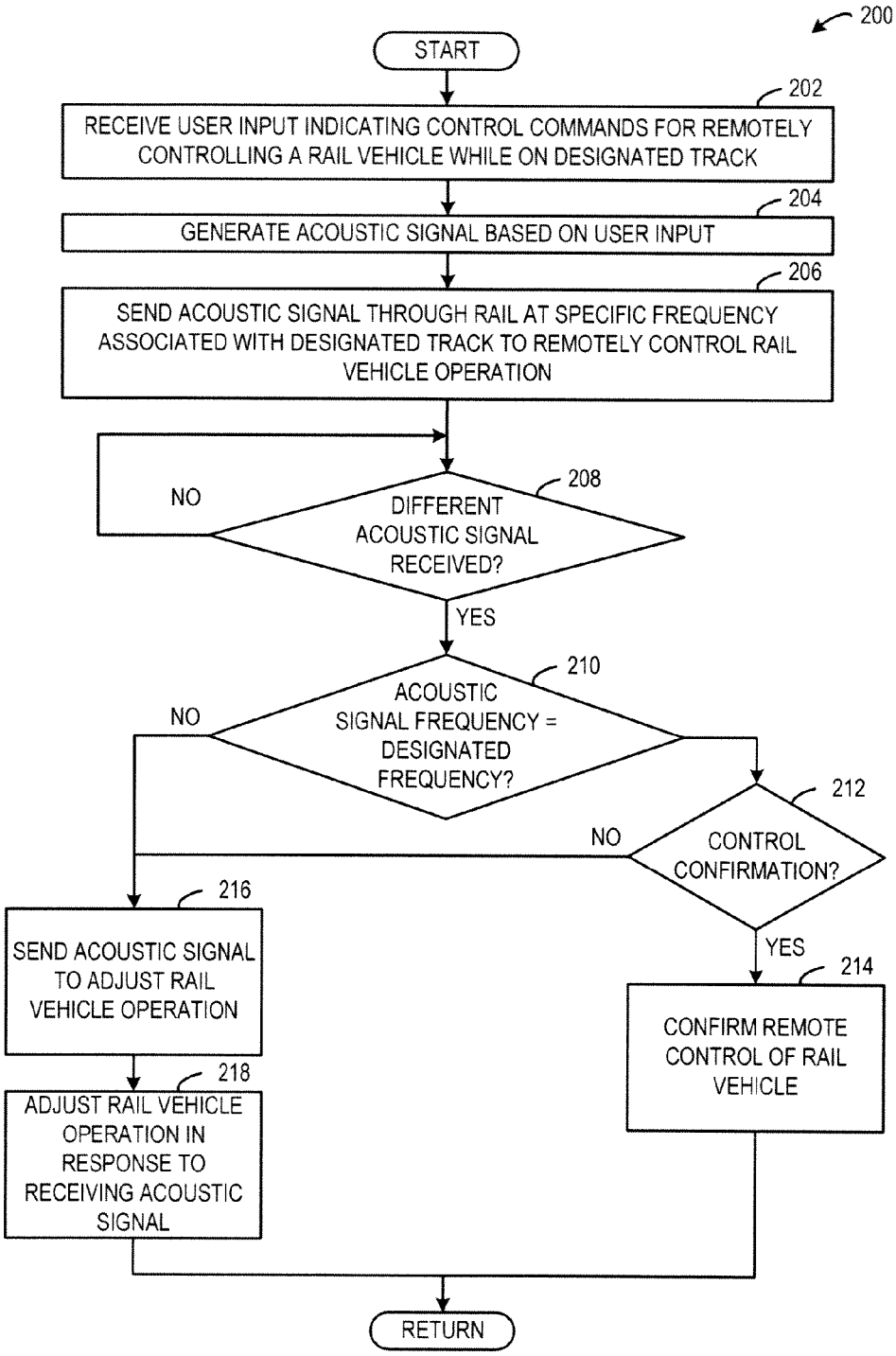
FIG. 2 is a flow diagram of an example embodiment of a method for sending acoustic signals through a rail to remotely control operation of a rail vehicle.

FIG. 2 is a flow diagram of an example embodiment of a method 200 for remotely controlling operation of a rail vehicle by providing communication, using acoustic signals, through a rail for a designated section of track. In one example, the method 200 is performed by the remote control unit 104 of the communication system 100 depicted in FIG. 1. In one example, the remote control unit 104 is postionally fixed relative to a designated section of track.

At 202, the method includes receiving user input indicating control commands for remotely controlling a rail vehicle while on the designated section of track. In one example, the control inputs 110 of the remote control unit 104 receive the user input. For example, the control commands include speed or braking controls to adjust a speed of the rail vehicle.

At 204, the method includes generating an acoustic signal based on the received user input. In one example, an acoustic coupling generates the acoustic signal. In one example, sound transducers generate the acoustic signal.

At 206, the method includes sending the acoustic signal through the rail. In one example, the acoustic signal is sent at a predetermined frequency that is associated with the designated section of track to remotely control rail vehicle operation. In one example, the predetermined frequency is outside of a frequency bandwidth of frequency signatures generated by operation of the rail vehicle, such as a signature of interaction of the rail vehicle's wheels with the rail. In one example, the predetermined frequency is specific to the designated section of track and different from frequencies of acoustic signals used for other sections of track. In one example, the audio transceiver 112 of the remote control unit

104 sends the acoustic signal at the predetermined frequency. In some examples, instead of (or in addition to) a designated frequency, the acoustic signal includes a unique identifier identifying the designated section of track. The unique identifier is used by units (e.g., rail vehicles, remote control unit, receiver unit, etc.) operating on the designated track.

In some embodiments, the method is an open-loop communication method where no feedback acoustic signals are received by the remote control unit 104. In such embodiments, the method 200 returns to other operations after 206.

At 208, the method includes determining if an acoustic signal is another acoustic signal is received through the rail at the remote control unit. If it is determined that an acoustic signal is received through the rail, the method moves to 210. Otherwise, the method returns to 208.

At 210, the method includes determining if a frequency of the received acoustic signal matches a frequency associated with the designated track. If the frequency of the received acoustic signal matches the frequency associated with the designated track, the method moves to 212. Otherwise, the method moves to 216.

At 212, the method includes determining if the received acoustic signal that matches the designated frequency is a confirmation that the acoustic signal was received at the rail vehicle. In other words, the method includes determining if the received acoustic signal is control feedback from the receiver unit. If it is determined that the acoustic signal is a confirmation of remote control of the rail vehicle, the method moves to 214. Otherwise, the method moves to 216.

At 214, the method includes confirming remote control of the rail vehicle by the remote control unit. In one example, confirming remote control of the rail vehicle includes providing an indication to the operator of the remote control unit 104 that the control commands have been received and remote control is functional. For example, visual indication, such as an illuminated or flashing light is provided to the operator.

In one example, the received acoustic signal has a frequency that corresponds to the designated frequency indicating that the acoustic signal was sent from the portable receiver unit 114. The acoustic signal includes a notification that the portable receiver unit 114 has detected that another rail vehicle has entered the designated section of track. In particular, when a rail vehicle traverses a physical gap between sections of track, the wheel of the rail vehicle temporarily closes the gap by contacting both rails simultaneously. During this moment, the two sections are acoustically connected allowing for an acoustic signal to pass from a rail in one section, through the wheel, and into a rail of the adjacent section. In some cases, when an acoustic signal traverses sections of track, the acoustic signal is received by the portable receiver unit and the notification is forwarded to the remote control unit.

In another example, the received acoustic signal is not at the designated frequency and includes information for a different section of track. As discussed above, the acoustic signal enters the section of track when two sections are acoustically connected due to a rail vehicle traversing the sections. Accordingly, the received acoustic signal provides an indication that a rail vehicle has entered the designated section of track. Since another rail vehicle has entered the designated section of track, rail vehicle operation is adjusted to accommodate the additional rail vehicle. Thus, at 216, the method includes sending acoustic signals including control commands to adjust operation of the rail vehicle. In one example, the control commands include commands to stop operation of the rail vehicle in an attempt to avoid collision with the rail vehicle. In another example, the control command includes commands to alert the other rail vehicle of its presences in the designated section of track, such as sounding an alarm, flashing headlights, sending a radio notification, etc.

At 218, the method includes adjusting operation of the rail vehicle in response to receiving the acoustic signal including control commands from the remote control unit.

By sending acoustic signals including control command through a rail to a remote rail vehicle, the rail vehicle can be wirelessly remote controlled without taking up bandwidth over the airwaves. The above method can be advantageously performed in a rail yard setting where the acoustic signals are confined to a designated section of track due to physical gaps in the rails created by switches, for example. Moreover, by adjusting operation based on receiving acoustic signal that provide an indication that another rail vehicle has entered the designated section of track, rail vehicle operation can be adjusted to accommodate the other rail vehicle, such as stopping to avoid collision.

Figure 3:
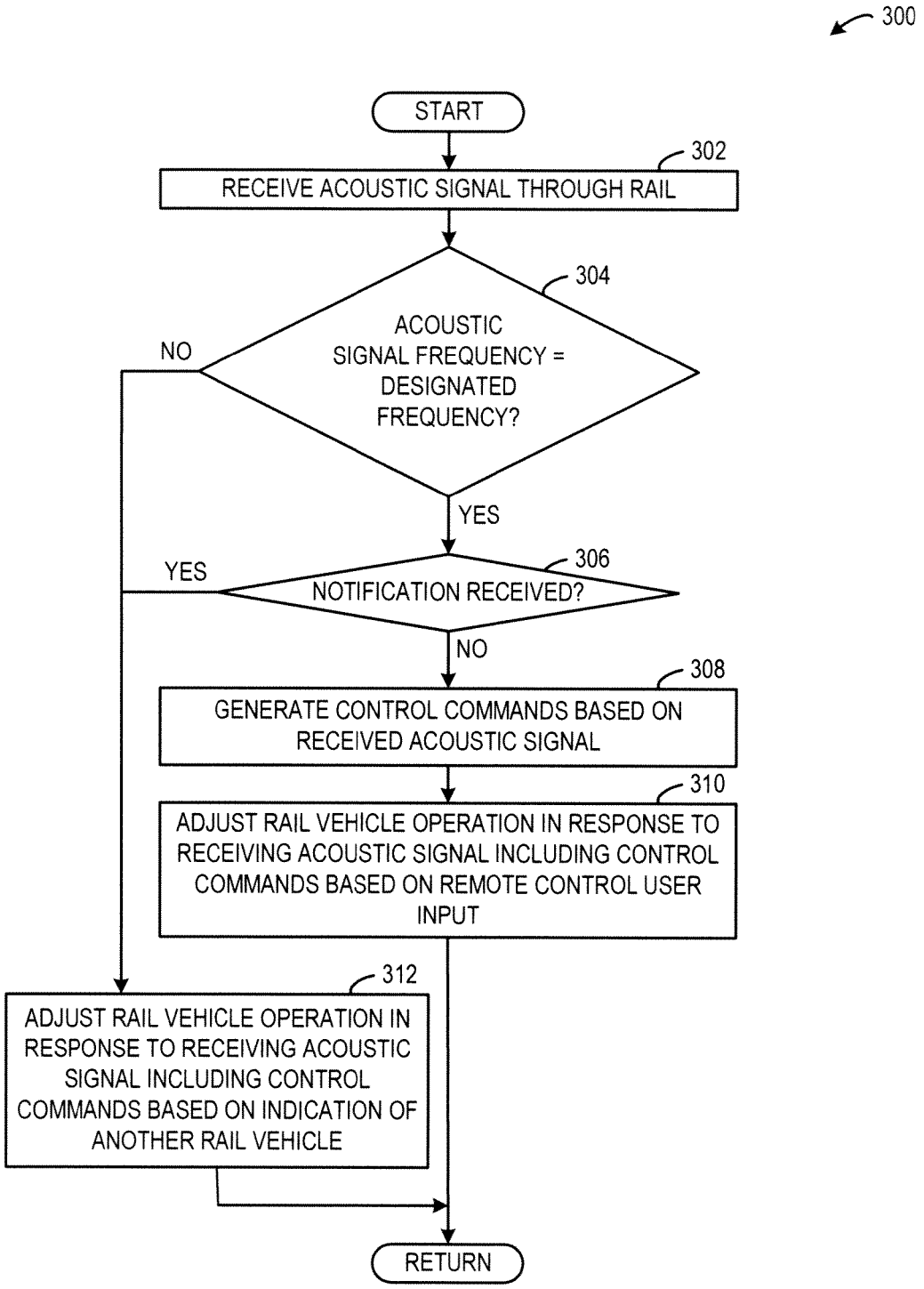
FIG. 3 is a flow diagram of an example embodiment of a method for receiving acoustic signals through a rail to control operation of a rail vehicle.

FIG. 3 is a flow diagram of an example embodiment of a method 300 for controlling operation of a rail vehicle based on receiving acoustic signals through a rail. In one example, the method 300 is performed by the portable receiver unit 114 of the communication system 100 depicted in FIG. 1.

At 302, the method includes receiving an acoustic signal from the rail. In one example, the audio transceiver 118 of the portable receiver unit 14 is positioned proximate to the rail to detect the acoustic signal.

At 304, the method includes determining if a frequency of the received acoustic signal corresponds to a frequency associated with the designated section of track. If the frequency of the received acoustic signal matches the frequency associated with the designated section of track, the method moves to 306. Otherwise, the method moves to 312. In some embodiments, if the frequency of the received acoustic signal does not match the designated frequency, then the signal is ignored.

At 306, the method includes determining if the received acoustic signal includes a notification that another rail vehicle has entered the designated track. If it is determined that the received acoustic signal includes a notification that another rail vehicle has entered the designated track, the method moves to 312. Otherwise, the method moves to 308.

At 308, the method includes generating control commands based on the received acoustic signal. In one example, the received acoustic signal originates from a remote control unit associated with the designated section of track, and the received acoustic signal includes control commands based on user input to the remote control unit.

At 310, the method includes adjusting rail vehicle operation in response to receiving an acoustic signal including control commands based on remote control user input. In one example, braking operations are adjusted in response to receiving the acoustic signal. In one example, speed of the rail vehicle is adjusted in response to receiving the acoustic signal. In one example, the acoustic signal includes control commands based on remote control user input provided at the remote control unit 104. In one example, the control commands are sent through the interface 126 to the on-board computing system 122 to adjust operation of the rail vehicle.

At 312, the method includes adjusting rail vehicle operation in response to receiving an acoustic signal including control commands based on an indication of another rail vehicle entering the designated section of track. In one example, the received acoustic signal has a frequency that corresponds to the designated frequency indicating that the acoustic signal was sent from the remote control unit 104. The acoustic signal includes a notification that the remote control unit 104 has detected another rail vehicle that has entered the designated section of track. In another example, the received acoustic signal is not at the designated frequency and includes information for a different section of track. As discussed above, the acoustic signal enters the section of track when two sections are acoustically connected due to a rail vehicle traversing the sections. Accordingly, the received acoustic signal provides an indication that a rail vehicle has entered the designated section of track. Since another rail vehicle has entered the designated section of track, rail vehicle operation is adjusted to accommodate the additional rail vehicle. In one example, the control commands include commands to stop operation of the rail vehicle in an attempt to avoid collision with the rail vehicle. In another example, the control command includes commands to alert the other rail vehicle of its presences in the designated section of track, such as sounding an alarm, flashing headlights, sending a radio notification, etc.

By controlling a rail vehicle based on acoustic signals received through a rail, the rail vehicle can be wirelessly remote controlled without taking up bandwidth over the airwaves.

Figure 4:
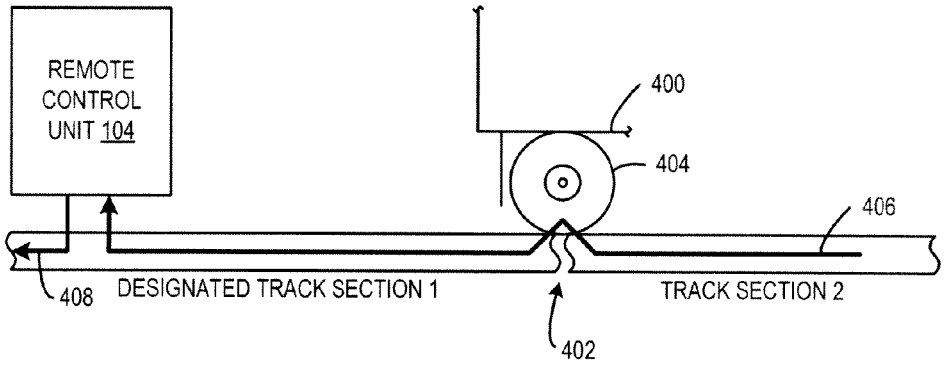
FIG. 4 depicts an example scenario where a remote control unit receives an audio signal that corresponds to a different track.

FIG. 4 depicts an example scenario where a remote control unit receives an audio signal that corresponds to a different track. The remote control unit 104 is acoustically coupled to a designated section of track (section 1) and is configured to send and receive acoustic signals through the rail of the designated section of track. A rail vehicle 400 is shown traversing between the designated section of track (section 1) and an adjacent section of track (section 2), which are physically separated by a gap 402. As the rail vehicle 400 spans the gap 402, a wheel 404 of the rail vehicle acoustically couples the designated section of track (section 1) with the adjacent section of track (section 2). While the designated section of track (section 1) and the adjacent section of track (section 2) are momentarily acoustically coupled, an acoustic signal 406 designated for the adjacent section of track (section 2) crosses the gap 402 through the wheel 404 into the designated section of track (section 1). In this example scenario, the remote control unit 104 is closest to the gap 402 (relative to a rail vehicle being controlled by the remote control unit on the designated section), and receives the acoustic signal 406. Since the acoustic signal 406 is designated for the adjacent section (section 2), the acoustic signal 406 has a frequency that corresponds to the adjacent section of track (section 2) and does not correspond to the designated section of track (section 1). The remote control unit 104 recognizes that the frequency of the acoustic signal 406 does not correspond to the designated frequency and sends an acoustic signal 408 at the designated frequency through the rail to a portable receiver unit coupled to a remote rail vehicle (not shown). In one example, the acoustic signal 408 includes control commands to adjust operation of the remote rail vehicle to accommodate the rail vehicle 400.

Figure 5:
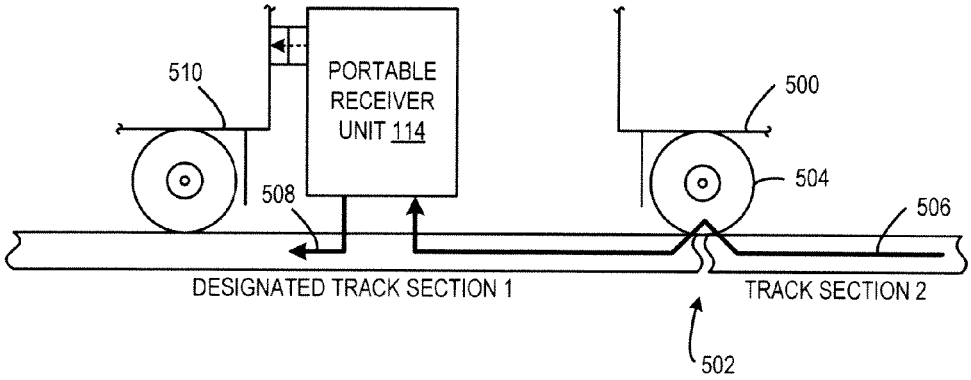
FIG. 5 depicts an example scenario where a portable receiver unit receives an audio signal that corresponds to a different track.

FIG. 5 depicts an example scenario where a portable receiver unit receives an audio signal that corresponds to a different track. The portable receiver unit 114 is coupled to a rail vehicle 510. The rail vehicle 510 is being remote controlled based on acoustic signals sent from a remote control unit, through a rail of the designated section of track (section 1) to the portable receiver unit 114. A rail vehicle 500 is shown traversing between the designated section of track (section 1) and an adjacent section of track (section 2), which are physically separated by a gap 502. As the rail vehicle 500 spans the gap 502, a wheel 504 of the rail vehicle 500 acoustically couples the designated section of track (section 1) with the adjacent section of track (section 2). While the designated section of track (section 1) and the adjacent section of track (section 2) are momentarily acoustically coupled, an acoustic signal 506 designated for the adjacent section of track (section 2) crosses the gap 502 through the wheel 504 into the designated section of track (section 1). In this example scenario, the portable receiver unit 114 is closest to the gap 502 (relative to a remote control unit coupled to the designated section), and receives the acoustic signal 506. Since the acoustic signal 506 is designated for the adjacent section (section 2), the acoustic signal 506 has a frequency that corresponds to the adjacent section of track (section 2) and does not correspond to the designated section of track (section 1). The portable receiver unit 114 recognizes that the frequency of the acoustic signal 506 does not correspond to the designated frequency, and in response, sends an acoustic signal 508 at the designated frequency through the rail to a remote control unit (not shown). In one example, the acoustic signal 508 includes a notification indicating that the rail vehicle 500 has entered the designated section. In one example, the portable receiver unit 114 sends control commands to adjust operation of the rail vehicle 510 to accommodate the rail vehicle 500. For example, operation of rail vehicle 510 is adjusted to stop the rail vehicle 510 in order to avoid a collision with rail vehicle 500. The above example scenarios demonstrate how a communication system that communicates by sending acoustic signals through a rail to remote control a rail vehicle on a designated section of track reacts by adjusting operation upon detection of another rail vehicle entering the designated section.

Although embodiments have been set forth herein relating to sending and receiving acoustic signals through a rail of a designated section of track, other embodiments relate to sending and receiving acoustic signals through rails generally. For example, one embodiment relates to a method for communicating through a rail of a track. The method comprises sending an acoustic signal through the rail, wherein the acoustic signal includes control commands to remotely control operation of a rail vehicle on the track. In another embodiment of a method for communicating through a rail of a track, the method comprises receiving an acoustic signal through the rail from a remote control unit (e.g., the remote control unit may be a fixed position unit, or it may be a portable unit). The method further comprises adjusting engine or braking operation of a rail vehicle based on control commands generated from (based on) the received acoustic signal.

Another embodiment relates to a communication system comprising a remote control unit. The remote control unit is configured for acoustic coupling to a rail of a track. When deployed for operation, the remote control unit is acoustically coupled to the rail. The remote control unit is configured to send, through the rail, an acoustic signal to remotely control operation of a rail vehicle on the track. Thus, in operation, the remote control unit, which is acoustically coupled to the rail, sends an acoustic signal through the rail, wherein the acoustic signal is adapted for remote control operation of a rail vehicle, e.g., the rail vehicle receives the acoustic signal and automatically changes its operation in response. In one embodiment, subsequent deployment for operation in controlling a rail vehicle remotely, the remote control unit is positionally fixed. In another embodiment, the remote control unit is portable/movable.

In another embodiment, the remote control unit comprises a remote control unit control subsystem and a transceiver (remote control unit transceiver, such as an audio transceiver) operably coupled to the remote control unit control subsystem. The remote control unit control subsystem is configured to accept operator input and to control the transceiver for the transceiver to generate a specific acoustic signal based on the operator input.

Another embodiment relates to a communication system comprising a receiver unit. The receiver unit is configured for coupling to a rail vehicle that travels along a rail. When deployed for operation, the receiver unit is coupled to the rail vehicle. The receiver unit comprises a transceiver (receiver unit transceiver, such as an audio transceiver) and a control system. The transceiver is configured for receiving an acoustic signal through the rail. Thus, when operated, the transceiver receives an acoustic signal through the rail. The control system is operably coupled to the transceiver for generating a control signal to adjust an engine or braking operation of the rail vehicle. That is, when the receiver unit is deployed for operation and thereby coupled to the rail vehicle, upon the control system generating the control signal, the receiver unit transmits the control signal (e.g., internal transmission through a cable or wire) to the rail vehicle (e.g., to a rail vehicle controller), with the rail vehicle adjusting an engine or braking operation based on the control signal; the control signal is generated by the receiver unit based on the acoustic signal received through the rail.

Another embodiment relates to a communication system comprising a remote control unit and a receiver unit. The remote control unit is configured for acoustic coupling to a rail of a track. When deployed for operation, the remote control unit is acoustically coupled to the rail. The remote control unit is configured to send, through the rail, an acoustic signal to remotely control operation of a rail vehicle on the track. The receiver unit is configured for coupling to the rail vehicle. When deployed for operation, the receiver unit is coupled to the rail vehicle. The receiver unit comprises a transceiver and a control system. The transceiver is configured for receiving an acoustic signal through the rail. The control system is operably coupled to the transceiver for generating a control signal to adjust an engine or braking operation of the rail vehicle. In operation, the remote control unit, which is acoustically coupled to the rail, sends an acoustic signal through the rail. The transceiver receives the acoustic signal through the rail. The acoustic signal is adapted for remote control operation of a rail vehicle. Thus, the receiver unit bases its generation of the control signal on the informational content of the acoustic signal received through the rail. Upon the control system generating the control signal, the receiver unit transmits (e.g., internal transmission through a cable or wire) the control signal to the rail vehicle (e.g., to a rail vehicle controller), with the rail vehicle adjusting an engine or braking operation based on the control signal.

In any of the embodiments set forth herein, the acoustic signal may be a mechanical wave that is an oscillation of pressure transmitted through the metal solid of a rail. In other embodiments, the acoustic signal may be a mechanical wave that is an oscillation of pressure transmitted through the metal solid of a rail at frequencies extending to and between 12 Hz and 20,000 Hz.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for communicating through a rail comprising:

sending an acoustic signal, through the rail of a designated section of track, including control commands to remotely control operation of a rail vehicle on the designated section of track;

receiving the acoustic signal, through the rail, at the rail vehicle; and adjusting engine or braking operation of the rail vehicle in response to the received acoustic signal, wherein the acoustic signal is sent from a positionally fixed remote control unit separate from the rail vehicle.

2. A method for communicating through a rail comprising:

sending an acoustic signal, through the rail of a designated section of track, including control commands to remotely control operation of a rail vehicle on the designated section of track;

receiving a feedback acoustic signal, through the rail, from a receiver unit confirming that the rail vehicle is being remotely controlled based on the acoustic signal; and in response to receiving the feedback acoustic signal, providing an indication to an operator confirming remote control of the rail vehicle.

3. A method for communicating through a rail comprising:

sending an acoustic signal, through the rail of a designated section of track, including control commands to remotely control operation of a rail vehicle on the designated section of track, wherein the acoustic signal is sent at a designated frequency or frequency bandwidth corresponding to the designated section of track, and the designated frequency or frequency bandwidth does not correspond to adjacent sections of track.

4. A method for communicating through a rail comprising:

sending an acoustic signal, through the rail of a designated section of track, including control commands to remotely control operation of a rail vehicle on the designated section of track;

receiving a different acoustic signal, at a frequency or frequency bandwidth other than a designated frequency or frequency bandwidth, indicating another rail vehicle has entered the designated section of track; and in response to receiving the different acoustic signal, sending another acoustic signal, through the rail of the designated section of track, to adjust braking operation of the rail vehicle to accommodate the other rail vehicle.

5. A communication system comprising:

a remote control unit, configured for acoustic coupling to a rail of a designated section of track, and to send, through the rail, an acoustic signal to remotely control operation of a rail vehicle on the designated section of track, wherein the remote control unit is positionally fixed, and wherein the positionally fixed remote control unit is further configured to receive acoustic signals through the rail.

6. A communication system comprising:

a receiver unit, configured for coupling to a rail vehicle that travels along a rail, the receiver unit comprising a transceiver for receiving an acoustic signal through the rail, and the receiver unit further comprising a control system operably coupled to the transceiver for generating a control signal to adjust an engine or braking operation of the rail vehicle, wherein the control signal is generated by matching a predefined control command that is mapped to the acoustic signal received through the rail.

7. The system of claim 6, wherein the receiver unit includes an interface to temporarily couple the receiver unit to the rail vehicle, the interface being compatible for temporary coupling to a plurality of different rail vehicles.

8. The system of claim 7, wherein the receiver unit is configured to, in response to receiving an acoustic signal at a different frequency bandwidth than a designated frequency bandwidth corresponding to a designated section of track, send an acoustic signal, through the rail, to notify a positionally fixed remote control unit that another rail vehicle has entered the designated section of track.

9. The system of claim 8, wherein the receiver unit is configured to, in response to receiving an acoustic signal at a different frequency than a designated frequency corresponding to the designated section of track, adjust engine or braking operation of the rail vehicle.

10. The system of claim 6, wherein the transceiver is an audio transceiver configured to transmit and receive audio signals through the rail.

11. The communication system of claim 6, wherein the receiver unit includes a microphone to detect the acoustic signal.

12. A method for communicating through a rail comprising:

receiving an acoustic signal through the rail of a designated section of track from a remote control unit; and adjusting engine or braking operation of a rail vehicle based on control commands generated from the received acoustic signal.

13. The method of claim 12, wherein the acoustic signal is received at a designated frequency bandwidth corresponding to the designated section of track, and the designated frequency bandwidth does not correspond to adjacent sections of track, and where the remote control unit is positionally fixed.

14. The method of claim 12, further comprising:

receiving a different acoustic signal at a frequency bandwidth different from the designated frequency bandwidth, indicating another rail vehicle has entered the designated section of track; and adjusting engine or braking operation of the rail vehicle in response to receiving the acoustic signal at the different frequency bandwidth.

* * * * *

UNITED STATES PATENT AND TRADEMARK OFFICE

CERTIFICATE OF CORRECTION

PATENT NO. : 8,651,434 B2
APPLICATION NO. : 12/911816
DATED : February 18, 2014
INVENTOR(S) : Daum et al.

It is certified that error appears in the above-identified patent and that said Letters Patent is hereby corrected as shown below:

In the Specification

In Column 6, Line 29, delete "fraction" and insert -- traction --, therefor.

Signed and Sealed this
Twenty-seventh Day of May, 2014

Michelle K. Lee

Michelle K. Lee
*Deputy Director of the United States Patent and Trademark Office*